United States Patent [19]

Edwards et al.

[11] 4,064,705

[45] Dec. 27, 1977

[54] AIR CONDITIONING SYSTEM HAVING COMPRESSOR-EXPANDER IN PRESSURIZED CLOSED LOOP SYSTEM WITH SOLAR ASSIST AND THERMAL STORAGE

[75] Inventors: Thomas C. Edwards, Cocoa Beach; Amir L. Ecker, Cocoa, both of Fla.

[73] Assignee: The Rovac Corporation, Rockledge, Fla.

[21] Appl. No.: 733,751

[22] Filed: Oct. 26, 1976

[51] Int. Cl.[2] ..... F25B 13/00

[52] U.S. Cl. ..... 62/2; 62/238; 62/402

[58] Field of Search ..... 62/2, 238, 324, 402

[56] References Cited

U.S. PATENT DOCUMENTS

| | | | |
|---|---|---|---|
| 2,704,925 | 3/1955 | Wood | 62/172 |
| 2,969,637 | 1/1961 | Rowekamp | 62/2 |
| 3,686,893 | 8/1972 | Edwards | 62/402 |
| 3,828,569 | 8/1974 | Weisgerber | 62/243 |
| 3,960,322 | 6/1976 | Ruff et al. | 62/238 |
| 3,967,466 | 7/1976 | Edwards | 62/121 |
| 3,991,938 | 11/1976 | Ramey | 62/238 |
| 4,018,581 | 4/1977 | Ruff et al. | 62/238 |

*Primary Examiner*—Lloyd L. King

*Attorney, Agent, or Firm*—Leydig, Voit, Osann, Mayer & Holt, Ltd.

[57] ABSTRACT

An air conditioning system for an enclosed space, capable of operating as a heat pump in the winter and as a refrigerator in the summer, of the type employing a unitary compressor and expander having a common rotor with vanes defining enclosed compartments for positive compression and expansion of air. An indoor heat exchanger and outdoor heat exchanger are provided with one being connected between the outlet port of the compressor and the inlet port of the expander and the other being connected from the outlet port of the expander to the inlet port of the compressor thereby to complete a loop which is charged with air. Valves are interposed for effectively interchanging the connections of the heat exchangers so that the indoor heat exchanger is used for warming in winter and cooling in summer. The outdoor heat exchanger is in the form of a solar-directed panel having a heat absorption surface and air passages for convection cooling. Means are provided for exposing the heat absorption surface and closing the air passages in the winter and for shielding the absorption surface and opening the air passages in the summer. A cold storage device is provided to serve as a heat source and to freeze water during the winter and with the melting of the resulting ice augmenting cooling effect during the summer. A heat storage device is also used to store heat during a winter day for release during the winter night. The loop is pressurized with air, the pressure being correctively varied by thermostatic control to vary the heat rate, thereby to maintain a set temperature both winter and summer in the enclosed space. The air in the loop is preferably moistened and a regenerator is optionally provided to increase the capacity of the system under extreme temperature conditions.

15 Claims, 18 Drawing Figures

(WINTER)
R
125
122
120
60
14
121
62
61
15
11
13
88
33
87
94
92
93
84
70
142
143
144
141
140
91
90
81
82
80
83
41
42
43
44
101
100
102
104
103
53
54
50
52
51
18
12

192
153
41
44
72
71
192a
16
70
75
74
73
SOURCE OF WATER
33
29'
28'
30'
29
28
30
20
27'
27
21
21'
32
26'
26
19
22
22'
24
23
25
25'
23'
24'
42
43
72a
71a
74a 84
81
82
80
85
86
DRAIN
83

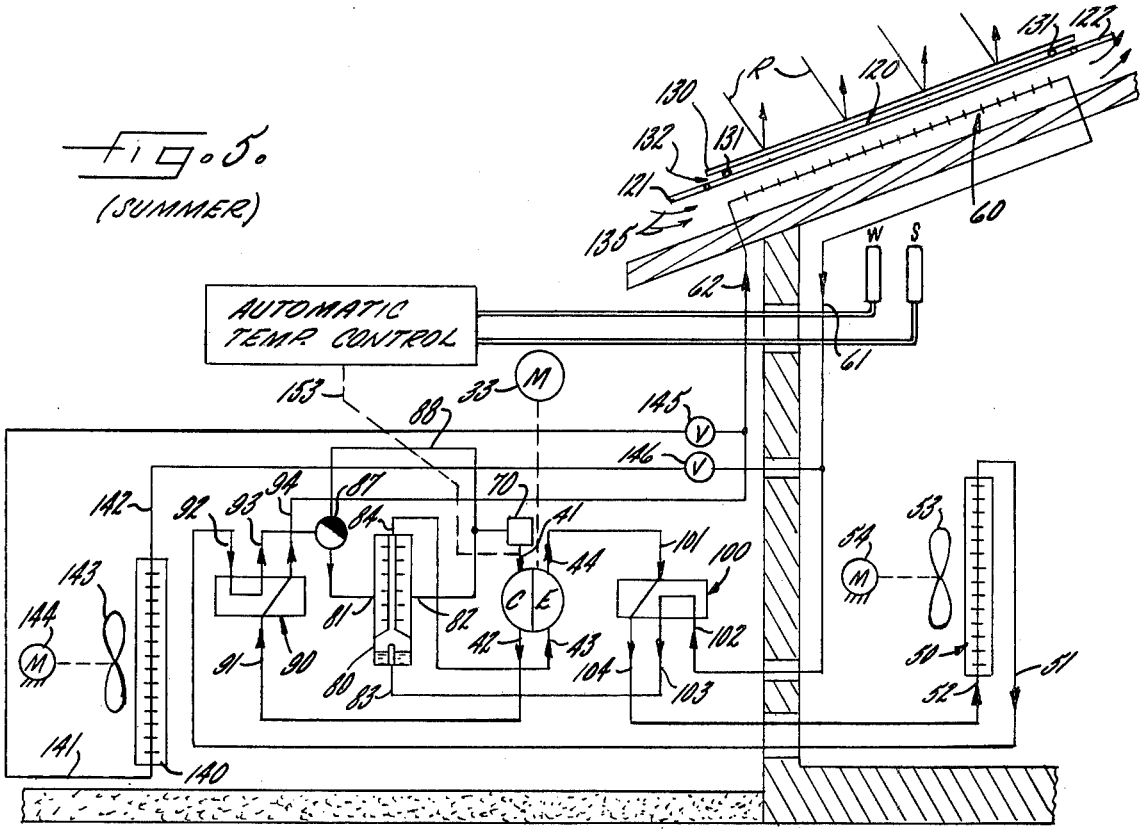
Fig. 5. (SUMMER)
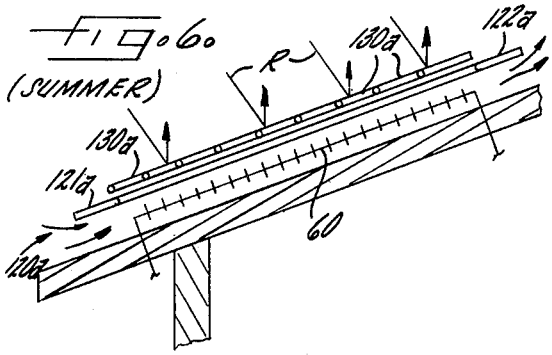
Fig. 6. (SUMMER)
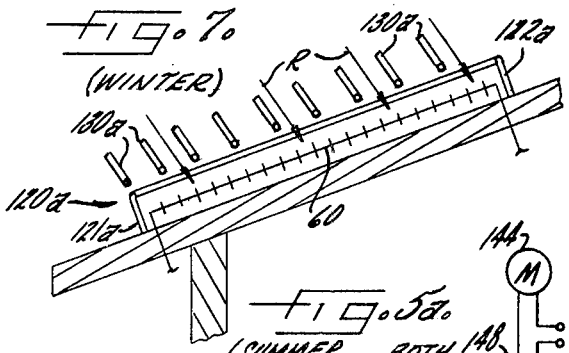
Fig. 7. (WINTER)
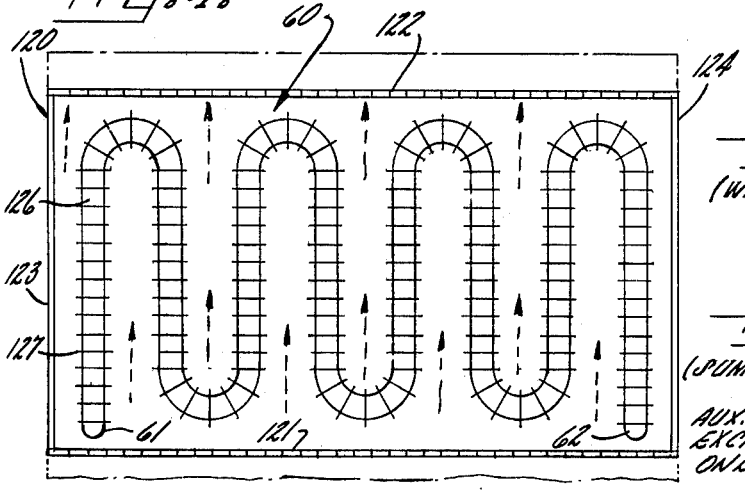
Fig. 4.
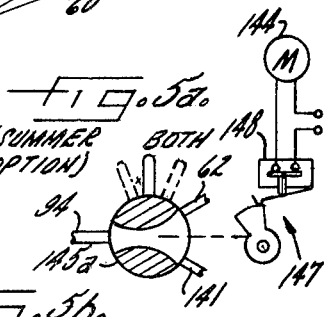
Fig. 5a. (SUMMER OPTION)
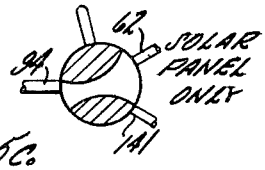
Fig. 5b. (WINTER)
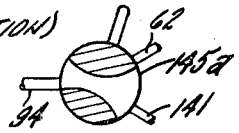
Fig. 5c. (SUMMER OPTION)

(SUMMER)

(WINTER)

ROCKS (WINTER DAY)
WATER (WINTER-NIGHT)
WATER (SUMMER)

(END OF SUMMER-WITH HEAT STORAGE)

AIR CONDITIONING SYSTEM HAVING COMPRESSOR-EXPANDER IN PRESSURIZED CLOSED LOOP SYSTEM WITH SOLAR ASSIST AND THERMAL STORAGE

In my prior patent application Ser. No. 627,114 entitled Heat Pump-Refrigeration System with Water Injection and Regenerative Heat Exchanger, now U.S. Pat. No. 4,017,285 issued Apr. 12, 1977, there is disclosed a winter-summer air conditioning system employing a compressor-expander with indoor and outdoor heat exchangers as well as a regenerative heat exchanger and with valves for shifting between winter and summer operation. In such system the air discharged at the expander outlet port is at atmospheric pressure.

It is an object of the present invention to provide a winter-summer air conditioning system employing a compressor-expander having indoor and outdoor heat exchangers with one of the heat exchangers being connected in primary position and the other in secondary position to complete a closed loop having a charge of air, sufficient air being injected into the system so that the secondary heat exchanger operates at a pressure substantially above atmospheric pressure thereby to bring about a substantial increase in the heat rate, or capacity, of the system as well as the capability of operating over a wide range of rate depending upon thermal demand.

It is a related object to provide a winter-summer air conditioning system employing a compressor-expander and which includes means for sensing the indoor temperature and for bringing about a corrective change in the heat rate of the system to maintain the temperature at a set level.

It is a further object of the present invention to provide an improved air conditioning system having indoor and outdoor heat exchangers in which the outdoor heat exchanger is in the form of a solar panel serving as a secondary heat exchanger absorbing solar heat during the winter and also a primary heat exchanger connected to dissipate heat during the summer.

It is a related object of the present invention to provide an improved winter-summer air conditioning system which is highly efficient and economical in operation and which, in addition to use of a solar panel, includes heat and cold storage devices operating respectively on a daily and seasonal cycle and which benefit the system in both directions of heat flow.

It is a general object of the present invention to provide a winter-summer air conditioning system employing a compressor-expander which operates with a high degree of efficiency under a wide range of seasonal and diurnal conditions, and which is flexible in use, easily and quickly shifted between its operating modes.

It is another general object of the invention to provide a winter-summer air conditioning system which is inherently simple and economical, which is long lived, requiring little or no maintenance, which is highly compact, which may be used with advantage in all types of building and in all climatic zones.

Other objects and advantages of the invention will become apparent upon reading the attached detailed description and upon reference to the drawings in which:

FIG. 1 is a schematic diagram of an air conditioning system constructed in accordance with the present invention employing a solar panel as a heat absorber and operating in the winter, or heat pump, mode;

FIG. 4 is a plan view of the solar panel looking along line 4—4 in FIG. 1;

FIG. 5 is a schematic diagram showing the system of FIG. 1 operated in the summer, or refrigeration, mode, and with addition of means for automatic temperature control;

Figure 9:
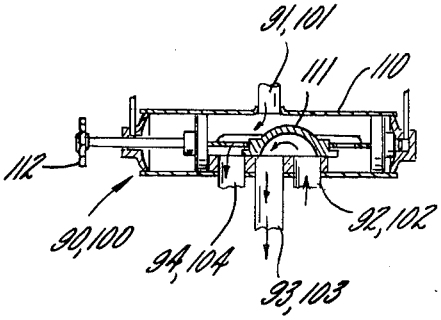
Figure 8:
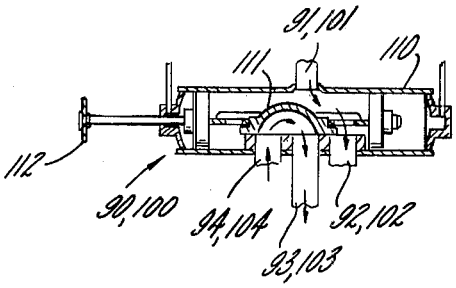
Figure 10:
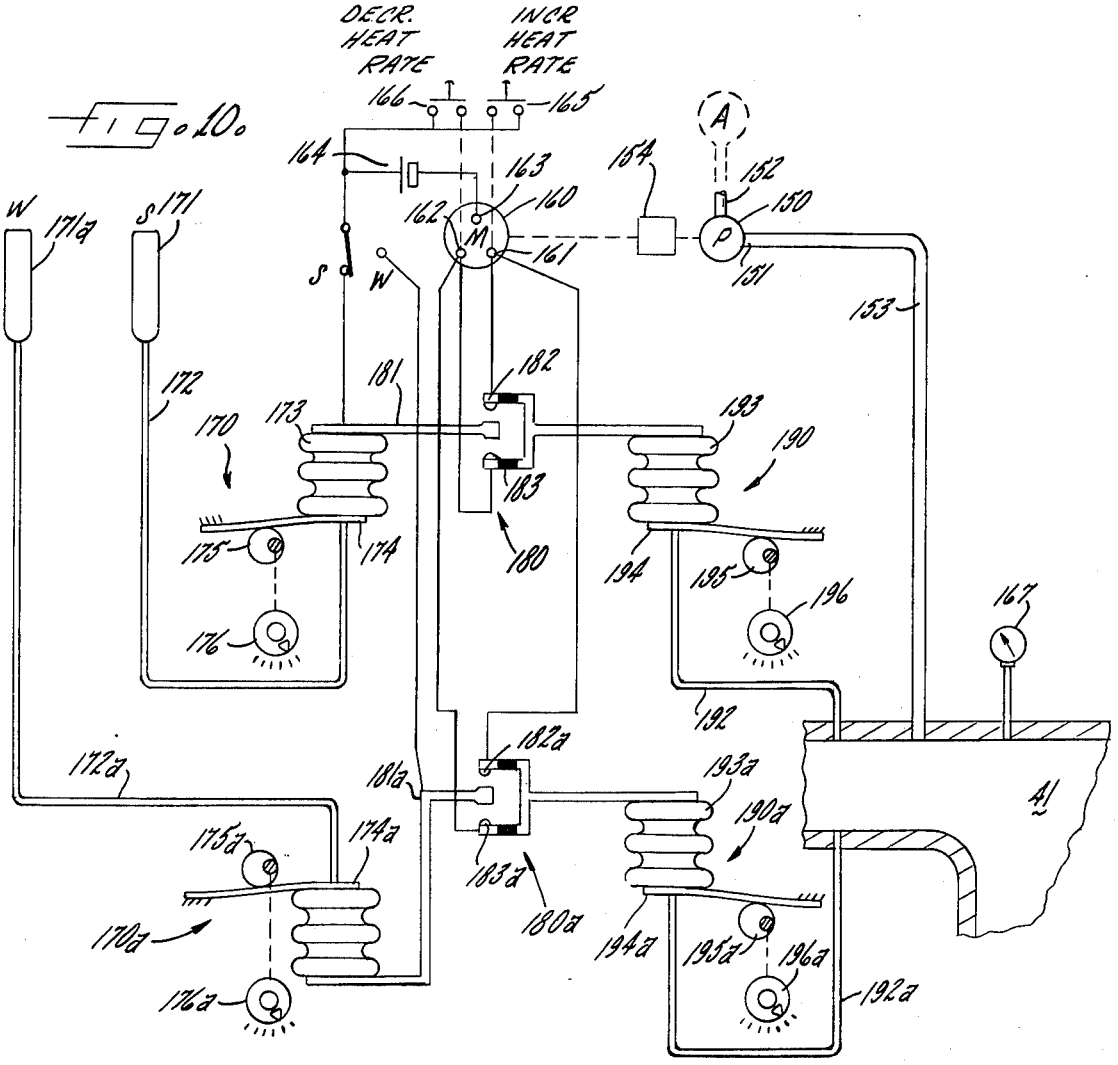

FIGS. 5*a*, 5*b*, and 5*c* show three positions of an auxiliary transfer valve which may be optionally employed in the system of FIG. 5;

FIG. 6 is a fragmentary elevational diagram showing in alternate form of solar panel as used in the summer mode;

FIG. 7 shows the panel of FIG. 6 in the winter mode;

FIG. 8 is a cross sectional view showing a preferred form of the transfer valve set for winter operation;

FIG. 9 is a view similar to FIG. 8 but showing the transfer valve in its summer setting; and FIG. 10 is a winter-summer thermostatic control system providing modulation of pressure, and hence heat rate, automatically in accordance with demand upon the system.

Figures 11, 11A, 12:
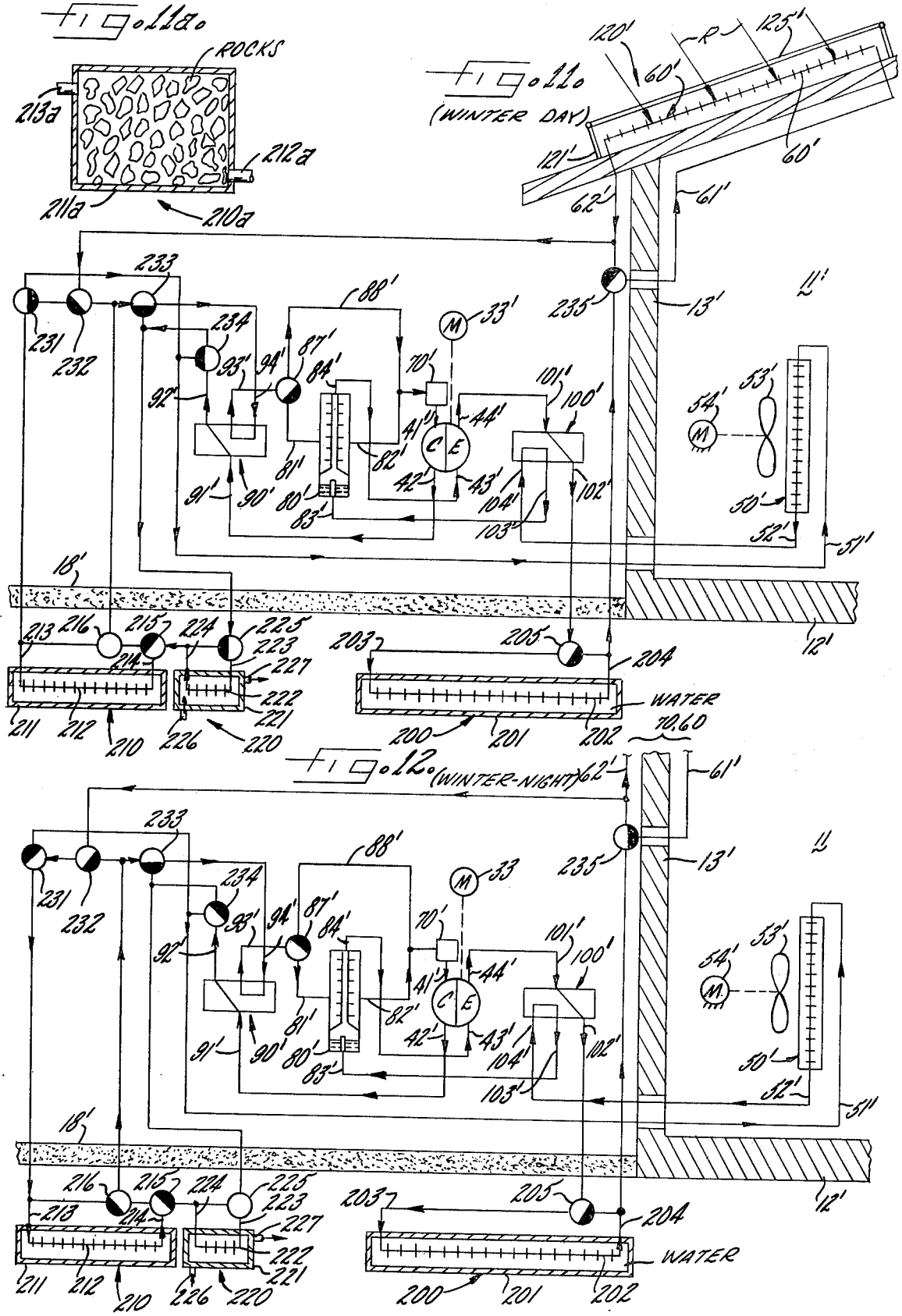

FIG. 11 is a schematic diagram of an air conditioning system similar to FIG. 1, and under winter day time conditions, but with provision for thermal storage.

FIG. 11*a* shows an alternate form of heat storage device which may be employed in the system of FIG. 11.

FIG. 12 is a schematic diagram similar to FIG. 11 but showing the valve settings under winter night time conditions.

Figure 13:
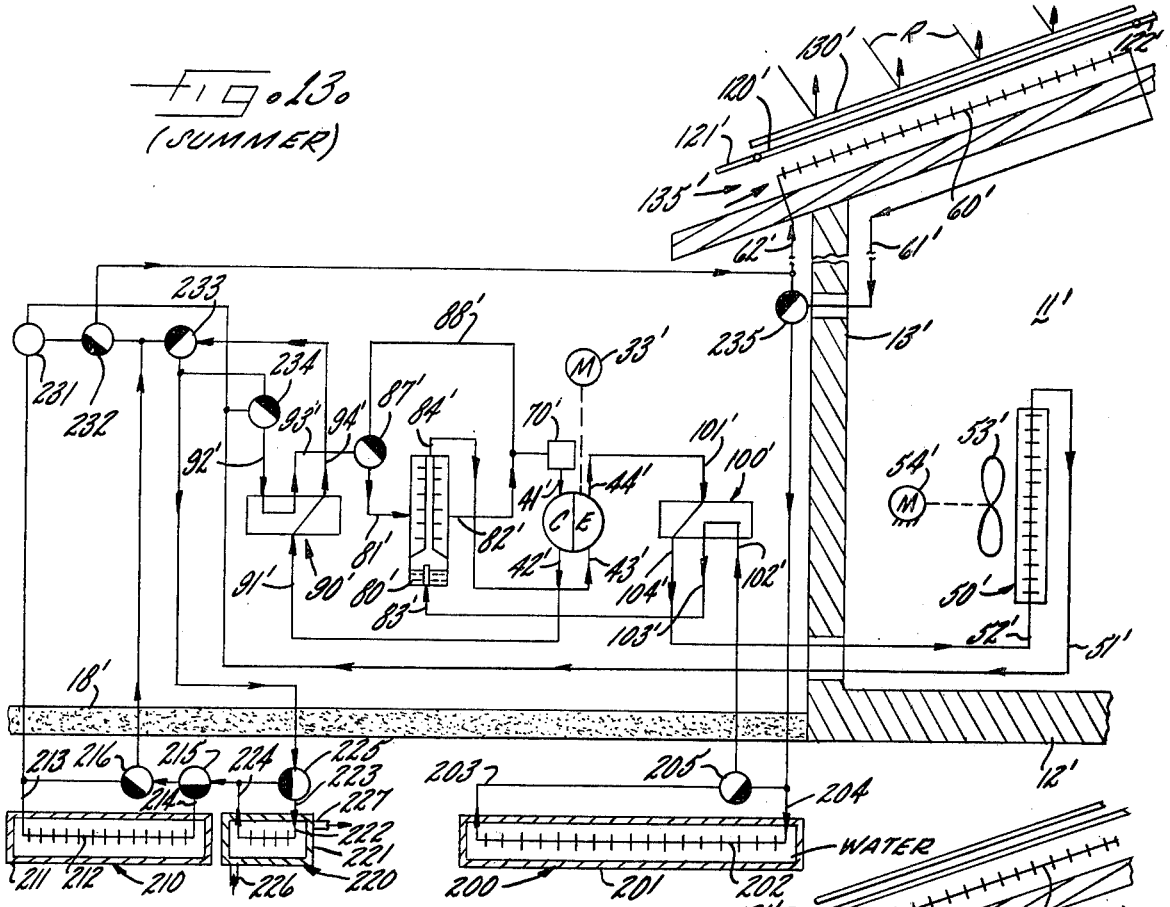

FIG. 13 is a schematic diagram similar to FIG. 5, under normal summer conditions, but including provision for thermal storage.

Figure 14:
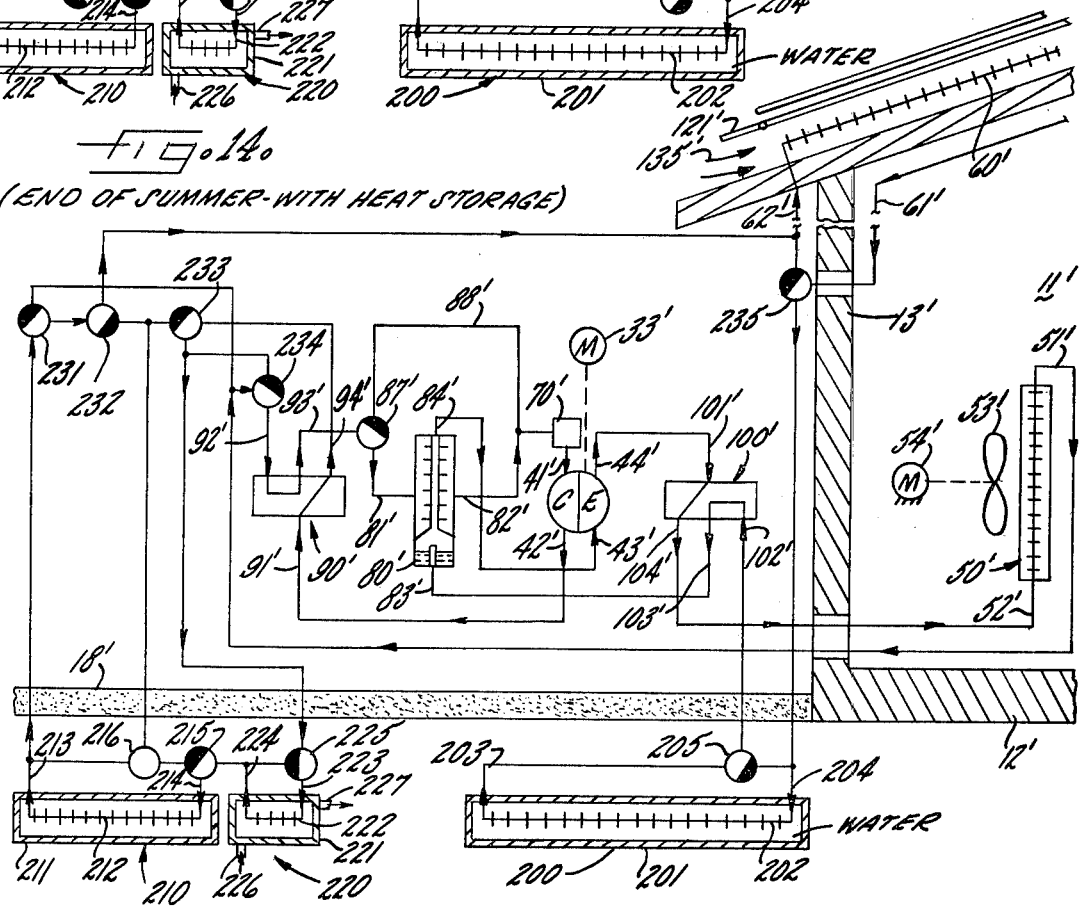

FIG. 14 is a schematic diagram similar to FIG. 13 but showing the valves set to produce heat storage under end-of-summer conditions.

While the invention has been described in connection with certain preferred embodiments, it will be understood that we do not intend to be limited to the particular embodiments shown, but intend, on the contrary, to cover the various alternative and equivalent constructions included within the spirit and scope of the appended claims.

Turning now to the drawings there is shown in FIG. 1 an enclosed living space 11, typically a house having a foundation 12, insulated side wall 13, and insulated roof 14, all constructed to reduce heat loss to the outside environment 15. In the discussion which immediately follows, it will be assumed that it is desired to maintain a temperature of 75° F within the living space while the temperature outside is 0° F.

Figure 2:
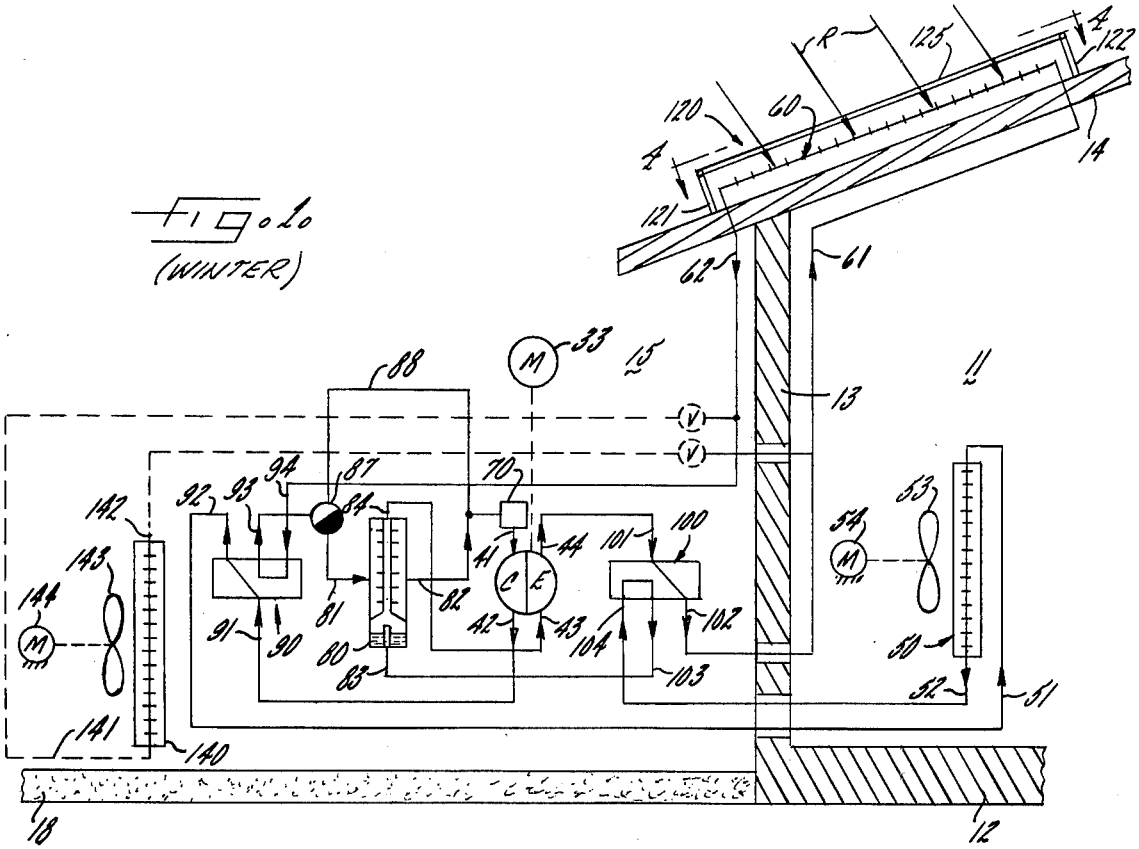
FIG. 2 is a cross sectional view of the compressor-expander used in the system of FIG. 1.
Figure 2:
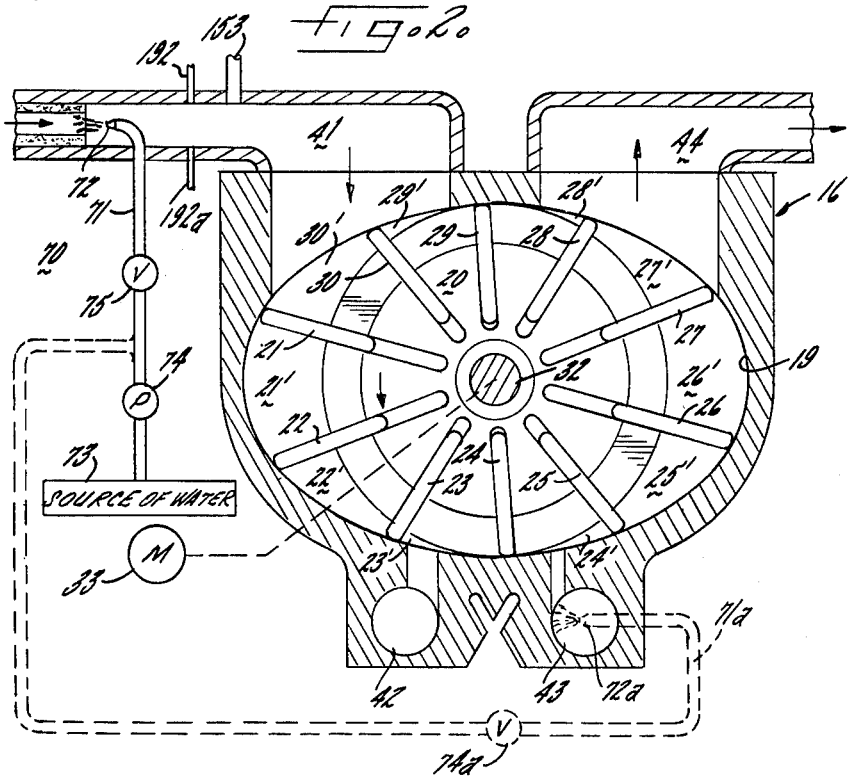
Figure 3:
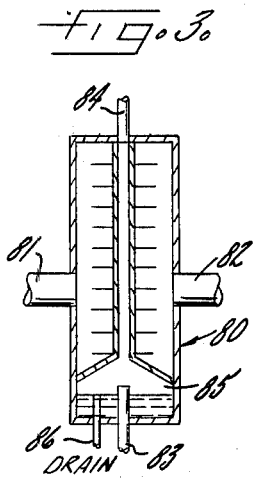
FIG. 3 is a diagrammatic cross section of the regenerative heat exchanger employed in FIG. 1.

The heart of the present air conditioning system is a compressor-expander 16 which may be mounted in an enclosure supported outside of the house upon a suitable concrete slab 18, or, alternatively, because the unit is inherently compact, a place may be readily found for it within the house. As shown in FIG. 2, the compressor-expander 16 has a chamber 19 of oval configuration. It will be understood that the chamber is enclosed at its ends, with parallel end members which are now shown but which are described in prior U.S. Pat. No. 3,904,327 which issued Sept. 9, 1975. Rotatable within the chamber is a rotor 20 having radially extending slideable vanes which may, for example, be 10 in number and which have been designated 21–30 inclusive. The rotor has a shaft 32 which is journaled in bearings (not shown) mounted in the respective end members, the shaft being connected to a driving motor 33. The speed of the driving motor may be on the order of 1750 rpm. The vanes are all pressed outwardly, in their respective slots, with the assistance of centrifugal force, to form enclosed compartments 21′–30′, respectively, which cyclically undergo a decrease and then an increase in volume in succeeding half cycles. The vanes are preferably guided in their inward and outward movement by providing each of the vanes with rollers rolling in cam tracks, as illustrated in above mentioned '327 patent. Thus assuming that the rotor turns in the direction shown by the arrows, the left hand half of the device acts as a positive compressor having an inlet port 41 and an outlet port 42, while the right hand side acts as a positive expander having an inlet port 43 and an outlet port 44.

In carrying out the present invention an indoor heat exchanger is provided in the enclosed space and an outdoor heat exchanger in the ambient atmosphere, one of the heat exchangers being connected in the "primary" or heating position between the compressor outlet port and the expander inlet port and the other heat exchanger being connected in the "secondary", or cooling, position between the expander outlet port and the compressor inlet port to complete a closed loop having a charge of air, with valve means for effectively interchanging the connections of the heat exchangers thereby permitting the indoor heat exchanger to be employed for warming in winter and for cooling in summer. The indoor heat exchanger, indicated at 50, has an inlet connection 51 and an outlet connection 52. With the device operated in a winter mode, the heat exchanger 50 is in the primary position, being effectively connected between the pressure outlet port 42 and expander inlet port 43. For the purpose of increasing transfer of heat and circulation of air within the enclosed space, a fan 53 is provided driven by a motor 54.

The outdoor heat exchanger, indicated at 60, has an inlet connection 61 and an outlet connection 62 which, in the winter mode, are effectively connected between the expander outlet port 44 and the compressor inlet port 41.

In the preferred form of the invention, moisture is included in the enclosed loop to increase the volumetric heat capacity of the medium flowing into the compressor while reducing the temperature of the medium exiting from the compressor to a level lower than that which would obtain in the dry state, thereby reducing the work required to compress the air and consequently the work required to drive the rotor. The resulting condensation of the water, occurring during the expansion process, serves to increase the temperature of the expanded air by release of the heat of vaporization thereby increasing the work of expansion and further reducing the loading upon the motor.

For a detailed discussion of the effect of water injection, reference is made to my prior U.S. Pat. Nos. 3,913,351 which issued Oct. 21, 1975 and 3,967,466 which issued July 6, 1976. To insure "loading" of the air with moisture, a water injector 70 may be provided including a water line 71 having a nozzle 72 (FIG. 2), the nozzle being supplied from a source 73 via a pump 74 and throttle valve 75 (FIG. 2). Water may be similarly injected into the expander inlet port 43 via a line 71*a* having a nozzle 72*a*. The source of water 73 may be a sump in the primary heat exchanger. Where water is injected only at the compressor inlet port, the pressure of the water at the sump is sufficient and the pump 74 may be dispensed with.

Further in accordance with a preferred form of the invention, a regenerative heat exchanger is provided for thermally coupling the air entering the compressor with the air entering the expander. Such heat exchanger, indicated at 80 has compressor connections 81, 82 in communication with the compressor inlet port and expander connections 83, 84 in communication with the expander inlet port. When the system is operated in the winter mode, illustrated in FIG. 1, the heat entering the expander and flowing through connections 83, 84 is transmitted to air flowing, via connections 81, 82, into the compressor. Thus, when the system is used as a heat pump under extremely cold conditions, the system "sees" outside air at a somewhat higher temperature thereby reducing the gradient over which the heat must be pump and resulting in an increase in heating capacity. The regenerative heat exchanger 80 has a sump 85 in which moisture may collect and which is preferably drained, via a line 86, back to the source 73. A valve 87 optionally bypasses the regenerator via line 88.

In accordance with one of the features of the present invention, transfer valves are provided for effectively interchanging the connections of the heat exchangers, thereby permitting the indoor heat exchanger to be employed for warming in winter and for cooling in summer. A transfer valve 90 may be of the 4-way type having connections 91–94, the connection 91 being connected to the outlet 42 of the compressor. A similar transfer valve 100 is provided on the expander side having connections 101–104, with the connection 101 being connected to the outlet of the expander. For a disclosure of a practical form of a transfer valve 90, 100 reference is made to FIG. 8 in which the valves are shown in the winter setting corresponding to FIG. 1 and to FIG. 9 in which the valves are shown in their summer setting corresponding to FIG. 5, to be described. Each valve includes a stator or frame 110 and a plunger 111 which may be manually shifted between the two conditions. The shifting may be done manually by handle 112 or the like or, if desired, the valves may be pilot operated with conventional means for applying pneumatic pressure alternatively to the opposite ends. Valves of the type illustrated are commercially available, for example, from Ranco Incorporated of Columbus, Ohio.

As another one of the features of the present invention, the outdoor heat exchanger 60 is in the form of a solar panel having an air conduit and having heat absorbing surfaces thermally coupled to the conduit for warming the conduit solar radiation, together with means defining cooling air passages thermally coupled to the conduit for cooling the panel by flow of ambient air. Means are provided during winter operation for shutting off the flow of cooling air so that the panel acts as an efficient solar heat absorber. Conversely, means are provided in the summertime for shielding the panel from the rays of the sun while permitting the flow of ambient air through the cooling passages so that the same panel acts as a heat dissipating device. Thus, referring to FIGS. 1 and 4 which illustrate winter operation, the outdoor heat exchanger 60 is incorporated in a panel 120 of flat box shape having a "lower" side wall 121 and "upper" side wall 122 and end walls 123, 124. The walls are joined by a transparent top panel 125, which may be made of glass, plastic, or the like to permit passage of the rays R of the sun while inhibiting circulation of ambient air and emittance of infrared radiaton. The air from the compressor-expander is circulated through a conduit 126 having heat absorbing surfaces which are shown, only rudimentarily, in the form of fins 127.

Operation of the system in the winter mode will be apparent upon considering the diagram of FIG. 1, starting with the cold air emanating from the compressor outlet connection 44. Such air, well below 0° F, is conducted through ports 101, 102 of the valve 100 to inlet port 61 of the solar panel 120 where it passes into conduit 126. The rays of the sun, freely penetrating the cover glass 125, warm the heat absorbing surfaces 127 so that the air flowing through the conduit 126 and out of the outlet 62 of the solar panel is warmed. By using an efficient design of solar panel it is possible, on a bright sunny day, to produce a temperature rise in the air on the order of 150° F, even though the ambient air is in the neighborhood of 0° F. The air, conducted through ports 94, 93 of valve 90, is, during solar operation, preferably bypassed via valve 27 and line 88 around the regenerative heat exchanger 80, so that the air flowing into the compressor inlet port 41, and which is subject to a moisture spray from nozzle 72, is at a temperature on the order of 150° F.

As the air is compressed on the left hand side of the compressor-expander (FIG. 2) its temperature and pressure both increase so that the air from the compressor, and which flows through the ports 91, 92 of valve 90, into the indoor heat exchanger 50 may, in a practical case, have a temperature of 290° F. Heat is substracted from air in the heat exchanger and circulated about the enclosed space by the fan 53 to establish a comfortable "living" temperature in the space on the order of 75° F. The air flowing from the heat exchanger 50, now at the relatively cooler temperature of, say, 78° F, enters the port 83 of the regenerative heat exchanger 80, which, if used, reduces the temperature of the air still further, say, to a level of about 30° F as it is fed into the expander port 43. By reason of the process of expansion, taking place at the right hand side of the compressor-expander, the air drops in both temperature and pressure, falling to a temperature substantially below 0° F, say, to about −40° F, thereby to complete a circulating cycle.

In carrying out the invention the system is operated in the summer, or refrigerating, mode by interchanging the connections of the indoor and outdoor heat exchangers, so that the indoor heat exchanger now cools instead of heats, by cutting off the radiation to the solar panel and by permitting the flow of ambient cooling air through the solar panel.

Thus, referring to FIG. 5, it will be noted that the transfer valves 90, 100 have been shifted (see also FIG. 9), thereby placing the indoor heat exchanger 50 into the secondary, or cooling, position in the circuit and the outdoor heat exchanger 60 in the primary, or heating position. In the summer mode it is the purpose of the heat exchanger 60 to dissipate heat. Consequently, to prevent the conduit 126 from being warmed by the rays of the sun, a shield 130 is interposed. Such shield may be formed of a rigid panel of opaque light-reflecting material which is coextensive with the glass pane 125 and which is preferably spaced with respect to the glass on short legs 131 to permit flow of ventilating air 132 in between. Alternatively, the shield 130 may be formed of opaque, flexible material as, for example, a sheet of aluminized mylar plastic which is supported directly upon the glass and which may, for convenience, be wound about a roll (not shown) which is rolled down, in the manner of an awning, in the summer, and rolled up to an out-of-the-way position in the winter. The solar panel is preferably insulated on its underside.

In addition to shielding of the solar panel from the rays of the sun, the solar panel is opened up along its lower and upper edges for convected flow of ambient air for cooling purposes. To this end the "lower" and "upper" sides 121, 122 of the solar panel are preferably hinged so that they may be swung from the air-obstructing position illustrated in FIG. 1 to the flow-permitting position illustrated in FIG. 5 in which the convection air currents, indicated at 135, are free to flow upwardly along the convolutions of the conduit 126 for cooling of the conduit and the hot "loop" air which is passing through it.

In short, the solar panel 120 can be used in winter as an efficient absorber of the radiant rays of the sun and used in summer as an efficient heat dissipating device, shielded from the rays of the sun, and with the heat being carried away by convected cooling air.

While the invention has been described in connection with a continuous shield 130, the solar panel may be shielded, for operation in the summer mode, by a closely spaced series of hinged vanes as illustrated in FIG. 6 in which corresponding elements are indicated by numerals carrying the subscript *a*. In this figure, the shielding vanes, indicated at 130*a*, are shown in their closed, shielding position. In the wintertime the vanes are swung upwardly into a position which is generally parallel to the rays R of the sun, as shown in FIG. 7, to permit such rays to act directly upon the solar panel, and the sides 121*a*, 122*a* are closed.

The summer mode may be briefly described in connection with FIG. 5. Starting again, for convenience, with the cold air discharged from the expander port 44, such air passes through ports 101, 104 of transfer valve 100, flowing into the inside heat exchanger 50 at a temperature which may be on the order of 10° F for cooling the room, the expanded air rising in temperature, during the process, to a temperature which may be on the order of 75°. Such air, passing through ports 92, 93 of transfer valve 90, passes through the regenerative heat exchanger, from which it exits at a temperature which may be on the order of 90° F. Upon entering the compressor the air is loaded with moisture and during compression undergoes an increase in both temperature and pressure, rising to a temperature which may be on the order of 230° F. The heated air, flowing through ports 91, 94 of the transfer valve 90, passes into the outdoor heat exchanger 60 where it is acted upon by currents 135 of ambient air to bring about cooling to approximately the level of 100° F, assuming average summer (up to 95° F) conditions, keeping in mind that the air, during cooling, is shielded from the direct rays of the sun. The air returning from the outside heat exchanger via ports 102, 103 of the transfer valve 100 next passes vertically through the regenerative heat exchanger 80 from which it exits at an creased temperature on the order of 85° F, with the air then entering the expander inlet port 43. In the expander the air undergoes a reduction in both pressure and temperature, thereby completing the operating cycle.

To increase the summertime cooling effect of the solar panel used as an outdoor heat exchanger, it is not necessary to rely upon convection currents 135 and, if desired, a fan may be provided for forcible blowing of ambient air through the solar panel. Such an addition is well within the skill of the art and might include a blower at one of the end walls 123, 124 and a vent at the other. However, in accordance with one of the more detailed aspects of the present invention it is contemplated to use, under particularly hot summer conditions, an auxiliary outdoor heat exchanger which may be connected in tandem with the regular outdoor heat exchanger 60. Such auxiliary heat exchanger, indicated at 140, has an inlet connection 141, an outlet connection 142 and a fan 143 driven by a motor 144. Valves 145, 146 connected respectively in the lines 141, 142 may be opened when auxiliary cooling effect is desired and kept closed at all other times.

If desired a three-way valve 145*a* may be substituted for the valve 145 as shown in FIG. 5*a*. Thus, under conditions of summertime operation, air from port 94 of transfer valve 90 is permitted to flow into both of the heat exchangers 60, 140. Under winter conditions flow is limited to the solar panel in accordance with the setting shown in FIG. 5*b*. As a further summer option, the auxiliary outdoor heat exchanger 140 may be used exclusively, using the valve setting set forth in FIG. 5*c*. If desired, a cam switch 147 having contacts 148 may be provided for automatic control of the auxiliary fan motor 144, serving to turn the motor on in both of the summer options. A companion valve, constructed in the same fashion as valve 145*a*, may be used as a substitute for valve 146, with the substitute valves being preferably ganged together.

In accordance with one of the important aspects of the present invention, means are provided for injecting air into the loop so that the pressure in the secondary heat exchanger is substantially greater than the atmospheric to increase the heat rate of the system and, conversely, means are provided for bleeding air from the loop to reduce the heat rate of the system so that a heat rate is achieved in accordance with the demands for heating or cooling effect which are placed upon the system. In carrying out the invention this is accomplished by providing an injector-bleeder pump of the positive displacement type having one of its ports connected to the loop circuit and which is driven by a reversible motor. Referring to FIG. 10 there is disclosed an air pump 150 having ports 151, 152, the port 151 being connected to the compressor inlet port 41 by an injection-bleed conduit 153. The pump has a mechanical coupling 154 to a motor 160 having forward and reverse connections 161, 162, with a common connection 163 which is connected to a source of current 164. Manual switches 165, 166 may be interposed in series with the motor connections 161, 162 for increasing and decreasing the pressure and hence the heat rate of the system.

Thus, upon pressing the switch 165 the motor rotates the pump in a direction to draw air inwardly through port 152, with the air being discharged under pressure from the port 151 via the conduit 153 into the loop. The switch 165 is maintained depressed until the desired pressure is built up in the secondary heat exchanger side of the loop as indicated by a pressure gauge 167. It will be understood that the pump 150 is not only of the positive displacement type but is "non-motoring" in the respect that it cannot act as an air motor under the influence of the pressure in the loop. This feature can be easily achieved by using a worm drive at connection 154. Thus once the pump builds up pressure in the system to the desired level, and the switch 165 is released, the pump is capable of holding the air at the set pressure level until there is an intentional change in pressure. An example of a positive displacement, low capacity pump available on the commercial market and capable of pumping either up or down is a tightly fitted vane type pump, equipped with automatic isolation valves only if leakage, during standby, is a problem.

Where it is desired to reduce the pressure and hence the heat rate of the system, the companion switch 166 is pressed thereby energizing the motor for rotation of the pump in a direction to bleed air from the loop via conduit 153, with the air being vented at port 152, eitherinto the atmosphere or into an accumulator A.

Further in accordance with the invention, means are provided for sensing the temperaure in the enclosed space and for producing an output signal as the temperature varies above and below a set level. Means responsive to the output signal are provided for rotating the motor, and hence the pump, in opposite directions to bring about a corrective change in system pressure.

Thus, referring further to FIG. 10 and assuming summer conditions, a "summer" thermostat 170 is provided including a bulb 171, a capillary 172 and a bellows 173, the bulb and bellows being charged with a vaporizable fluid. The bellows is secured to a flexible mount 174 positioned by a cam 175 which is under the control of a setting knob 176. Connected to the free end of the bellows is a switch 180 having a first contact 181 and cooperating contacts 182, 183 in straddling position, the contacts being respectively connected to the motor forward and reverse contacts 161, 162. The "summer" season switch contact S is closed.

In the event that the temperature in the space rises above the level set by the control 176, the increase in temperature, causing expansion of the bellows 173, results in upward movement of the contact 181 until the contact 182 is engaged, thereby energizing the forward contact 161 of the motor which results in rotation of the pump 150 in such a direction as to pump, or inject, air into the system via the conduit 153, thereby to increase the heat rate of the system so that greater cooling effect is correctively produced in the indoor heat exchanger 50, tending to bring the temperature down to the set level.

However, in accordance with the present invention provision is made for follow-up action to provide a modulatng effect and so that the pressure does not build up to an excessive level. Thus, we provide an adjustable follow-up control 190 having a capillary 192 leading to a follow-up bellows 193 or equivalent device responsive to system pressure. To facilitate adjustment the bellows 193 is mounted upon a flexible mount 194 positioned by a cam 195 under the control of a setting knob 196. Thus, upon an increase in loop pressure resulting from contact between contacts 181, 182, the bellows 193 expands, lifting the upper contact 182 from contact 181 and breaking the circuit to the pump motor 160. The breaking of contact prevents any undue build-up of pressure and permits the system to operate at an augmented heat rate for additional cooling effect but without overshoot of the temperature in the lowering direction.

The converse operation occurs in the event the temperature in the space should go below the set level. Specifically a drop below set level causes contraction of the bellows 173 and the making of contacts 181, 183, causing the motor 160 to rotate in the reverse direction so that air is bled from the system by pumping out at a slow rate with venting at the port 152. The reduction in system pressure causes contraction of the bellows 193 and the lowering of contact 183 so that it is disengaged from the thermostat contact 181 before the system pressure becomes excessively low. The system then operates at a reduced heat rate until the temperature in the enclosed space rises to the set level, again, with overshoot being avoided by the follow-up action. Automatic control of the temperature occurs in a completely analogous fashion under winter conditions with the "winter" contact W being closed and the "summer" contact S being opened. Corresponding parts in the winter temperature control system are indicated by corresponding reference numerals with addition of subscript "*a*". It will suffice to say that, under winter conditions, a drop in temperature at the bulb 171*a* causes the motor 160*a* to drive the pump, via shaft 154*a*, in its forward direction to increase the heat rate, while an increase in the temperature of the enclosed space has the opposite effect. Because of the action of the follow-up assembly 190*a*, overshoot of temperature in both directions is prevented.

It is one of the advantages of the system, operated either as a heat pump in winter or as a refrigerator in summer, that the pressure, and hence heat rate, is always in accordance with the thermal demand of the enclosed space. A large temperature "error" brings about a large change in heat rate, while a small error changes the heat rate only slightly. Moreover, the BTU per hour required for heating in winter is, on the average, considerably greater than the BTU rate required for cooling in summer. Thus, it is one of the advantages of the present system that the same compressor-expander is operated at widely different average pressures with widely different heat rates under the two seasonal conditions. For example, on an extremely cold day the thermostat will call for heat, by a proportional pressurization of the system, until air has been injected into the system sufficient to raise the level of the pressure in the secondary (indoor) heat exchanger to a level of approximately five atmospheres. By contrast, on a very warm day in summer, the thermostatic control will call for a pressure in the secondary (outdoor) heat exchanger to a level of, say, only two atmospheres. This is contrasted with a heat pump-refrigerator of the conventional Freon type in which substantially the same pressure exists both winter and summer. Simply stated, a compact air conditioning system constructed in accordance with the invention, and employing a compressor-expander, no larger than, say, a breadbox, can, by working at relatively low pressure, easily cool a small house. The same unit can, under winter conditions, heat the same house simply by operating at a substantially higher pressure to produce a heat rate tailored to the large BTU requirements of winter heating. While the efficiency of a system employing a compressor-expander is inherently high, such efficiency is further increased, under winter conditions, by the assistance given by the solar panel. Under summer conditions it is found that the solar panel, appropriately shielded, and with flow of ambient air, provides sufficient cooling so that it is not necessary to invest in a separate outdoor heat exchanger. Nevertheless, the system includes provision for an auxiliary outdoor heat exchanger 140 for use in southern latitudes where the weather is especially hot at the peak of the summer season.

It is a further feature of the present system, in both its winter and summer modes, that operation may take place at extremely low heat rates and with the compressor-expander running substantially idly. Thus, on a day where the temperature out of doors does not depart by more than a few degrees from the indoor temperature, the thermostat will call for an extremely low heat rate. The system responds by energizing the motor to drive the pump in the bleed direction in which the pump acts as a vacuum pump to draw the temperature within the secondary heat exchanger down below the atmospheric level. In short, the system is capable of modulating downwardly to a level approaching zero heat rate in which the motor 33 is in idling condition, and there is no necessity for the on-off type of cycling which is characteristic of more conventional air conditioners.

The term "enclosed space" as used refers generally to the region which is being controllably heated or cooled and the term "air conditioning system" refers to the means for bringing about the heating or cooling. Air has been mentioned as the preferred medium in the above discussion and is especially desirable where there is replenishment from the ambient atmosphere and venting or bleeding back to the atmosphere. However, it will be apparent that the invention is not limited to use of air, and other compressible gases may be employed, particularly non-condensing gases. In such event the connection 152 of the pump 150 can be directed to an accumulator in the form of a pressure storage tank charged to an intermediate pressure. Consequently the term "air" is to be interpreted in a general sense to cover both air and its possible substitutes, including vaporous mixtures.

One of the advantages of the above pressurized closed system is that the system may be charged with a quantity of lubricant for lubricating the vanes and the roller which guide and support the vanes. Where water is employed to reduce the driving requirement and to enhance the coefficient of performance as taught in the '327 and '904 patents mentioned above, lubricant may, if desired, be in emulsified form. The term "water" includes equivalent condensible liquids.

Although it is preferred to employ a compressor-expander of the type in which both compression and expansion take place in different portions of the same chamber, it will be understood that, if desired, the compressor and expander portions may be separate, even though mechanically coupled together, without departing from the present invention. And while flat radially-sliding vanes are used in the preferred embodiment, it will be understood that the term "vane" as used herein refers to any means for forming enclosed compartments which are progressively contracted and expanded as the rotor is driven.

Also while it is preferred to utilize a thermostat for varying system pressure thereby to vary the heat rate, the invention is not limited thereto but contemplates using a high system pressure, with the secondary heat exchanger operating substantially above atmospheric pressure, while varying the heat rate correctively by some other convenient means as, for example, varying the driving speed under the thermostatic control as taught in my copending application Ser. No. 627,114.

The present invention has been discussed above in relatively simplified form without provision for thermal storage. Reference will next be made to the preferred form of the invention illustrated in FIGS. 11–14 in which the system includes both provision for the storage of heat from the winter day to the winter night and means for storage of "cold" from winter to summer on a seasonal basis.

Consider first the conditions of operation of the preferred system on a typical winter day as illustrated in FIG. 11. In this figure the elements previously described carry the same reference numerals with the addition of a prime. The cold storage device, generally indicated at 200, will be understood to be in the form of an insulated tank 201 which is filled with water and which has, passing through it, an air conduit 202 which is thermally coupled to the water by fins or the like. The conduit 202 is provided with end connections 203, 204 having an optional bypass valve 205 which will be understood, in the discussion which follows, to be in the non-bypassing condition. In carrying out the invention the cold storage device 200 is interposed in series with the outlet port of the expander in winter and in series with the inlet port of the expander in summer. This is accomplished, in the present instance, by opening the line 102 from the transfer valve 100 and by interposing the air conduit 202 of the cold storage device 200 between the transfer valve and the connection 61' of the solar panel. Thus the cold storage device is subjected to the extremely cold air which flows from the outlet connection 44' of the expander and through the ports 101, 102 of the transfer valve, and upon winter usage of the device day by day, the body of water contained in the tank 201 is gradually converted to ice. This change of state is accompanied by absorption of large quantities of heat or, stated conversely, the freezing of ice serves to store a large amount of heat absorption capacity, or coldness, which may be conveniently measured in BTU, from the winter to the summer season. Indeed, where the storage tank 201 is, say, a 10 foot cube, sufficient "cold" can be stored to maintain a dwelling at a cool temperature for a period on the order of 2 months, during which time the compressor-expander 16' is driven more or less idly by its driving motor 33'. Even after the ice is entirely melted, the sensible heat absorbed by the water in rising approximately 50 additional degrees Fahrenheit is sufficient to cool the dwelling for another several weeks before normal mechanical cooling capacity of the system is called upon.

In accordance with one of its further aspects, the preferred form of the invention includes means for interposing a heat storage device in series with the outlet port of the compressor during a winter day and in series with the inlet port of the compressor during the winter night. The heat storage device, indicated generally at 210, is in the form of a tank 211 containing a charge of water and having an air conduit 212 with ports 213, 214, the tank being well insulated.

Associated with the ports 213, 214 are a pair of bypass valves 215, 216. Connected effectively in series with the heat storage device 210 is a domestic hot water heater 220 having a tank 221, an air conduit 222, an inlet port 223 and an outlet port 224. Bridging the ports is a bypass valve 225. Penetrating the tank 221 is a cold water inlet connection 226 connected to the domestic supply and a hot water outlet connection 227 serving the hot water faucets of the dwelling.

Referring to the top portion of FIG. 11 the valving is completed by a set of valves 231–235. All of the valves associated with the storage devices will be understood to be of the common three-way type, capable of blocking off a selected one of the ports while permitting passage between the remaining two.

In FIG. 11 the valves are set in the winter day mode in which the storage device 210 is connected, via the domestic hot water heating tank 220, to the outlet port of the compressor to effect storage of heat during the day for use at night when the outdoor heat exchanger 60' in the solar panel 120' is ineffective and is turned off. The direction of flow of air during the condition illustrated in FIG. 11 is indicated by the arrows. Thus starting at the port 42' of the compressor, where high temperature, high pressure air is discharged, air is fed through the ports 91', 92' of the transfer valve 90', through valve 234 and into the valve 225 associated with the domestic hot water tank. The hot air flows through the conduit 222 in the tank, thence through valve 215 into the conduit 212 of the heat storage device heating the water therein. It will be understood that the heat storage device is tailored, in size, to the size of the space or dwelling being serviced and, typically, the tank 211 may have a capacity of between 4,000 and 8,000 gallons of water.

The amount of heat which will be stored in a single day will depend upon the outdoor temperature and the brightness and directness of the sun's rays, but it is contemplated in a practical case that heat on the order of 200M BTU to 350M BTU will be stored.

The heat storage device 210 performs a dual function. It not only stores heat for liberation during night time hours but it also subtracts heat from the hot pressurized air which exits from the compressor with the result that the air which enters the expander is at a relatively low temperature which is lowered further as a result of the process of expansion.

the air from the heat storage device 210, having lost some of its heat, passes through the valve 231 and thence through line 51' into the inside heat exchanger 50' where a large portion of the remaining sensible heat is transferred to the enclosed space.

Continuing the flow of air in the loop circuit, the air exiting from the inside heat exchanger, after passing through the transfer valve 100', and the regenerative heat exchanger 80', is fed into the inlet port of the expander. After expansion, and with the air at a subzero temperature, the air passes again through the transfer valve 100' and through the cold storage device 200, already described, from which the air passes through the valve 235 into the solar panel. The air, after undergoing an increase in temperature in the stroage device 200, suffers a further increase in the solar panel, and the warmed air, flowing through valves 232, 233, the transfer valve 90', and the regenerative heat exchanger, passes to the inlet port 41' of the compressor, thereby completing the cycle. As a result of the day's operation, and with the assistance provided by the solar panel, the interior of the dwelling has been kept warm, water has been heated in the domestic hot water tank 220, heat has been stored in the storage device 210, and additional ice has been manufactured in the cold storage device 200.

Upon setting of the sun, or somewhat before, the valve settings are changed to correspond to those shown in FIG. 12 which sets forth the winter night time condition. The settings of the valves 215, 216, 231, 232, 234 and 235 are all changed as indicated. The transfer valves 90', 100', however, remain in the initial condition. As a result of the change in the valve settings the heat storage device is switched from a position in series with the outlet port of the compressor to a position in series with the inlet port. This may be made clear by tracing through the cycle starting with the expander outlet port 44'. The air, at low temperature,from this port is fed to the cold storage device 200 where the manufacturing of ice continues and where the air undergoes a temperature increase. Since the solar panel valve 235 is shut off, the air from the cold storage device passes through valves 232, 231 and into the left-hand port of 213 of the heat storage device 210. The air, which is warmed by the heat stored in the device 210, passes through valves 215, 216 and thence through valve 233 and through ports 94', 93' of the transfer valve 90'. From the transfer valve the air is passed through the regenerative heat exchanger into the inlet port 41' of the compressor. In short, the heat storage device, for winter night time operation, takes the place of the solar panel and serves as a "bridge" to insure efficient operation of the system even during those times when the sun is not shining. Preferably the domestic hot water tank 220 is sufficiently well insulated as not to require continued recharging with heat during the night time hours when usage of hot water is, in any event, at a minimum.

When the sun rises on the following day the valves are restored to the day time condition set forth in FIG. 11.

Having understood the operation, with thermal storage, in the winter mode, attention may next be given to FIG. 13 which shows the valve settings for operation in the summer mode, with heating of domestic hot water, but with the heat storage device 210 turned off.

For summer operation the transfer valves 90', 100' are both shifted to the positions shown, valves 215, 216 and 225 in the lower portion of the figure are reset, and valves 232–235 are set as shown, the position of the valve 231 being immaterial. As previously described in connection with FIG. 5, two changes are made in the solar panel, the heat absorbing surfaces are obstructed by a shield 130 and the lower and upper sides 121, 122 of the panel are upraised to permit free flow of convected air 135', thus converting the panel from a heat absorbing device to a heat dissipating device, with transfer of the heat to the ambient air.

One effect of switching the transfer valve 100' is to switch the cold storage device 200 from the output of the expander to the input of the expander. Thus it will be recalled that during the winter season the cold storage device, being subjected to the cold output air from the expander, changes the state of the contained water from liquid form to ice, thereby creating a large heat absorption capability. One of the effects of switching the transfer valve 100' is to make use of this heat absorption capability by lowering the temperature of the air fed into the expander port 43'. The fact that the cold storage device 200 is, in FIG. 13, in series with, and ahead of, the expander inlet port can be readily verified by following the arrows in FIG. 13. Thus it will be noted that the air which passes through the cold storage device and upwardly from the valve 205 flows through ports 102', 103' of the transfer valve and thence through the regenerative heat exchanger 80 to the expander inlet port 43'. By lowering of the temperature of the air entering the expander inlet port, the temperature of the air exiting from the expander outlet port 44', and which serves, in the inside heat exchanger 50', to cool the enclosed space, is proportionately lowered or, stated in other words, the effectiveness of the expander in cooling air is increased.

By reason of the setting of the valves in the summer condition, a continued supply of domestic hot water is assured. Thus, starting with the hot compressed air exiting from the compressor outlet port 42', such air flows through ports 91', 94' of the transfer valve 90', thence through valve 233 and valve 223 into the conduit 222 of the water heater, which not only heats the water but which serves, desirably, to cool the hot compressed air. The air exiting from the water heater next flows through valves 215, 216, and through valve 232, into the solar panel where the air is additionally cooled, in heat exchanger 60', by the convected currents of cooling air 135'. Upon exiting of the air, now at a cooler temperature, from the solar panel through valve 235, the air passes through the cold storage device 200, and thence to the expander inlet port, as previously described.

Because of the low temperature of the air which enters the expander, even under hot summer conditions, the melting of the ice in the cold storage device 200 enables the system to substantially idle, with the result that the heat absorption capacity of the ice reduces the current required by the drive motor 33' to substantially the idling current for a period which may be measured in terms of two months, more or less, that is, until the ice in the cold storage device has melted and until the resulting water has risen appreciably in temperature.

As the end of the summer approaches, and during the fall and spring seasons when occasional cold or overcast days are to be expected, it is desirable to switch the valving to the condition shown in FIG. 14 in which condition heat is stored in the heat storage device 210 to place the system in a condition of readiness. The valve settings differ from the settings of FIG. 13 in that valves 215, 231, 232 and 233 are set to include the heat storage device 210 in series with the domestic water heater; in other words, the heat storage device is interposed in the loop to receive heat from the air stream just prior to the time that the air is passed to the solar panel. Thus the air from the domestic water heater is passed by valve 215 into the storage device 210, exiting at port 213, from which the air is passed through valves 231, 232 to the port 62' of the solar panel. While the enclosed space continues to be cooled by the heat exchanger 50, as in FIG. 13, the heat storage device 210 is, as a byproduct, warmed and therefore in readiness for a cool, sunless day on which the system may be switched to the winter-night (FIG. 12) mode, in which the heat storage device 210 takes the place of the solar panel, and with the "winter" contact W (FIG. 10) being closed. The term "winter" as used herein is a general one, including any day when heating of the enclosed space is required, the term "summer" being the converse of this.

The flexibility provided by the valving described above permits quick and easy accommodation of the system to abrupt and extreme changes in the weather: For a warm summery day but with changeable weather expected the system is operated in the mode of FIG. 14. For a cold day but with the sun bright, or only partially obscured, the system is operated in the mode of FIG. 11. On a cold day, with the sun completely obscured and with the solar panel relatively ineffective, or for winter-night operation, the valves are set in the FIG. 12 mode. In all of the modes the compressor-expander may be driven continuously, with automatic modulation by the control arrangement of FIG. 10, so that the pressure in the secondary heat exchanger may actually go below atmospheric under conditions of low demand, resulting in substantially idle rotation of the drive motor. To facilitate setting the modes, the valves should preferably be of the remotely-operable solenoid type, permitting them to be set up in the predetermined combinations of FIGS. 11–14 by a common selector switch, the selector switch being utilized, as well, to energize the appropriate contacts "W" and "S" in FIG. 10.

If, as a result of a long cold winter, the cold storage device 200 has frozen into a solid supercooled block of ice, the bypass valve 205 may be moved to its bypassing condition thereby reducing the frictional load imposed upon the air stream.

In the device as described the heat storage device 210 employs water as the storage element. If desired, the heat storage device can be constructed as shown in FIG. 11*a* in which corresponding reference numerals have been employed with addition of subscript *a*. Thus as shown in the latter figure a sealed tank 211*a* is provided filled with rocks, crushed stone, aluminum oxide, or lumps of other solid material having a high heat capacity and having randon air passages in between. Air is admitted through an inlet port 212*a* and exits through a discharge port 213*a*. The tank 211*a* is preferably sealed and pressure resistant so as to prevent leakage in the face of the hot compressed air flowing from the outlet port of the compressor.

It will be understood that the term "heat rate" as used herein refers to the rate that heat is transferred, either in heating or in cooling, between the enclosed space and the environment.

While the solar panel has been shown and discussed as being on the roof of the building, preferably in upwardly sloping position for convected flow of cooling air in the summer mode, the invention is not limited thereto, and the solar panel may be mounted flatly on the outside of the south wall of the building without departing from the present invention. Use, against the building wall, in vertical position has been found to have a number of unusual features and advantages: In the first place there is, in the summer mode, better convection of cooling air. Secondly, in the winter mode, placing the solar panel against the wall insures that any heat which is radiated inwardly from the panel, rather than being dissipated in the attic of the building, is transmitted through the wall directly into the living space. A further advantage of the vertical against-the-wall position is that the solar panel is much more easily installed; indeed, installation of even a rather large panel by the householder is possible and practical. With regard to physical protection it should be noted that during the summer season, when children are normally out of doors, the panel will, in accordance with the present invention, be physically shielded, as well as radiation-shielded, by the shielding panel 130–130*a*. However, the term "means for disabling" the heat absorbing surfaces, while perferably a shield, is not limited thereto but includes any means for rendering the available solar heat ineffective.

Nor does mounting the solar panel vertically on the building wall appreciably reduce the insolation during the winter season since the sun during such season, in temperature zones, travels a relatively low arc through the sky. Studies show that there is only a relatively small price to pay in absorbed radiation, something on the order of fifteen percent, which is outweighed by improved summer cooling efficiency and the other advantages mentioned above. Accordingly, the term "sloping" as used herein applied to the orientation of the solar panel shall mean any orientation which is capable of vertically convected flow of cooling air and thus includes within its scope the possibility of mounting the solar panel with a "slope" of 90°, i.e., in a vertical orientation.

It will be noted that in discussing the operation, the regenerative heat exchanger 80, 80' is stated to be functioning in some cases and by-passed in others. The net advantage of using regeneration depends upon conditions: calculations show it may be desirable to use it during the winter night mode but not during a bright, sunny winter day. Accordingly, the regenerative heat exchanger may be considered purely as an option.

An advantage of the system is that by modulating downwardly to an idling condition in the summer mode, the system continues to provide dehumidification even at low heat rates. However, means may, if desired, be provided to entirely deenergize the motor 33, especially in the winter mode, as an alternative to the idling condition and to save the energy represented by machine function.

While the invention is preferably practiced using a secondary heat exchanger which seals the system into a closed loop and which is operated at above atmospheric pressure, the invention, in certain of its aspects, is not limited thereto and includes the possibility of "opening" the lines leading to the secondary heat exchanger for direct discharge of air. For example, referring to FIG. 5, which illustrates the summer mode, connections 51, 52 to the device 50 may be opened for direct discharge of cold air into the space from the line 52, with direct intake of warmed air from the space via line 51. In such event, the space itself becomes the "indoor heat exchanger" to complete the loop even though the loop is not closed. Similarly in the winter mode, FIG. 1, the line 62 may be opened so that the cold air from the expander is discharged directly into the ambient atmosphere, in which case the ambient atmosphere itself becomes the "outdoor heat exchanger". Indeed, the term "heat exchanger" is intended as a general term referring to any heat exchanging means which may be unitary or in multiple parts and regardless of whether all or only a part thereof is utilized for heat exchanging purposes.

In the system as described, air is passed through the conduit of the outdoor heat exchanger 60 forming a part of the solar panel. However, the term "having an air conduit", as applied to the solar panel does not necessarily require that the conduit be located within the panel if separate thermal coupling means are employed.

We claim as our invention:

1. In an air conditioning system for an enclosed space the combination comprising a compressor having an inlet port and an outlet port, an expander having an inlet port and an outlet port, the compressor and expander having rotor means coupled together and including vanes for positive compression and expansion as the rotor means is driven, and indoor heat exchanger in the enclosed space, an outdoor heat exchanger in the ambient atmosphere, one of the heat exchangers being connected in primary position between the compressor outlet port and the expander inlet port and the other heat exchanger being connected in secondary position between the expander outlet port and the compressor inlet port to complete a closed loop having a charge of air, valve means for effectively interchanging the connections of the heat exchangers thereby permitting the indoor heat exchanger to be employed for warming in winter and for cooling in summer, the outdoor heat exchanger being in the form of a solar panel having an air conduit and having heat absorbing surfaces thermally coupled to the conduit for warming the conduit by solar radiation, the panel having means defining cooling air passages thermally coupled to the conduit for cooling the conduit by flow of ambient air, and means for alternatively abling and disabling the heat absorbing surfaces and the cooling air passages thereby causing the same outdoor heat exchanger to act as a solar heat absorber in winter and heat dissipating device in summer.

2. In an air conditioning system for an enclosed space the combination comprising a compressor having an inlet port and an outlet port, an expander having an inlet port and an outlet port, the compressor and expander having rotor means coupled together and including vanes for positive compression and expansion as the rotor means is driven, an indoor heat exchanger in the enclosed space, an outdoor heat exchanger in the ambient atmosphere, one of the heat exchangers being connected in primary position between the compressor outlet port and the expander inlet port and the other heat exchanger being connected in secondary position between the expander outlet port and the compressor inlet port to complete a closed loop having a charge of air, valve means for effectively interchanging the connections of the heat exchangers thereby permitting the indoor heat exchanger to be employed for warming in winter and for cooling in summer, the outdoor heat exchanger being in the form of a solar panel having an air conduit and having heat absorbing surfaces thermally coupled to the conduit for warming the conduit by solar radiation, the panel having means defining cooling air passages thermally coupled to the conduit for cooling the conduit by flow of ambient air, means for alternatively abling and disabling the heat absorption surfaces and the cooling air passages thereby causing the outdoor heat exchanger to act as a solar heat absorber in winter and heat dissipating device in summer, means for injecting air into the loop to raise the pressure in the heat exchanger in secondary position to substantially above atmospheric to increase the heat rate of the system during periods of high demand and means for bleeding air from the loop to reduce the heat rate of the system during periods of relatively lower demand.

3. In an air conditioning system for an enclosed space the combination comprising a compressor having an inlet port and an outlet port, an expander having an inlet port and an outlet port, the compressor and expander having rotor means including vanes for positive compression and expansion as the rotor means is driven, indoor heat exchanger means in the enclosed space, outdoor heat exchanger means in the ambient atmosphere, one of the heat exchanger means being connected in primary position between the compressor outlet port and the expander inlet port and the other heat exchanger means being connected in secondary position between the expander outlet port and the compressor inlet port to complete a closed loop having a charge of air, valve means for effectively interchanging the connections of the heat exchanger means thereby permitting the indoor heat exchanger means to be employed for warming in winter and for cooling in summer, the outdoor heat exchanger means including a solar panel having a conduit and having heat absorbing surfaces thermally coupled thereto for warming the conduit by solar radiation, the outdoor heat exchanger means having passages for cooling by flow of ambient air, means for alternatively abling and disabling the heat absorption surfaces and the cooling air passages thereby permitting the outdoor heat exchanger means to act as a solar heat absorber in winter and a heat dissipating device in summer, the pressure in the heat exchanger in secondary position being substantially above atmospheric pressure.

4. In an air conditioning system for an enclosed space the combination comprising a compressor having an inlet port and an outlet port, an expander having an inlet port and an outlet port, the compressor and expander having rotor means including vanes for positive compression and expansion as the rotor means is driven, indoor heat exchanger means in the enclosed space, outdoor heat exchanger means in the ambient atmosphere, one of the heat exchanger means being connected in primary position between the compressor outlet port and the expander inlet port and the other heat exchanger means being connected in secondary position between the expander outlet port and the compressor inlet port to complete a closed loop having a charge of air, valve means for effectively interchanging the connections of the heat exchanger means thereby permitting the indoor heat exchanger means to be employed for warming in winter and for cooling in summer, the outdoor heat exchanger means including a solar panel having a conduit and having heat absorbing surfaces thermally coupled thereto for warming the conduit by solar radiation, the outdoor heat exchanger means having passages for cooling by flow of ambient air, means for alternatively abling and disabling the heat absorption surfaces and the cooling air passages thereby permitting the outdoor heat exchanger means to act as a solar heat absorber in winter and a heat dissipating device in summer, means for sensing the temperature in the enclosed space and for producing an output signal at the temperature varies above and below a set level, means for injecting air into the loop so that the pressure in the secondary heat exchanger is substantially greater than atmospheric to increase the heat rate of the system, means for bleeding air from the loop to reduce the pressure and thereby relatively reduce the heat rate, and means responsive to the output signal for alternatively actuating the injecting means and the bleeding means for maintenance of the temperature at the set level.

5. In an air conditioning system for an enclosed space the combination comprising a compressor having an inlet port and an outlet port, an expander having an inlet port and an outlet port, the compressor and expander having rotor means including vanes for positive compression and expansion as the rotor means is driven, indoor heat exchanger means in the enclosed space, outdoor heat exchanger means in the ambient atmosphere, one of the heat exchanger means being connected in primary position between the compressor outlet port and the expander inlet port and the other heat exchanger means being connected in secondary position between the expander outlet port and the compressor inlet port to complete a closed loop having a charge of air, transfer valve means for effectively interchanging the connections of the heat exchanger means thereby permitting the indoor heat exchanger means to be employed for warming in winter and for cooling in summer, means for injecting air into the loop so that the pressure in the secondary heat exchanger is substantially greater than atmospheric to increase the heat rate of the system for winter operation, and means for bleeding air from the loop to reduce the pressure and thereby relatively reduce the heat rate for summer operation.

6. In an air conditioning system for an enclosed space the combination comprising a compressor having an inlet port and an outlet port, an expander having an inlet port and an outlet port, the compressor and expander having rotor means coupled together and including vanes for positive displacement compression and expansion as the rotor means is driven, an indoor heat exchanger in the enclosed space, an outdoor heat exchanger in the ambient atmosphere, the indoor heat exchanger being connected between the compressor outlet port and the expander inlet port and the outdoor heat exchanger being connected between the expander outlet port and the compressor inlet port to complete a closed loop having a charge of air, the outdoor heat exchanger including a solar panel having an air conduit and having heat absorbing surfaces thermally coupled to the conduit for warming the conduit by solar radiation, means for injecting air into the loop to raise the pressure in the secondary heat exchanger substantially above atmospheric to increase the heat rate of the system during periods of high demand and means for bleeding air from the loop to reduce the heat rate of the system during periods of relatively lower demand.

7. In an air conditioning system for an enclosed space, the combination comprising a compressor having an inlet port and an outlet port, an expander having an inlet port and an outlet port, a compressor and expander having rotor means coupled together and including vanes for positive displacement compression and expansion as the rotor means is driven, an indoor heat exchanger in the enclosed space, an outdoor heat exchanger in the ambient atmosphere, one of the heat exchangers being connected in primary position between the compressor outlet port and the expander inlet port and the other heat exchanger being connected in secondary position between the expander outlet port and the compressor inlet port to complete a loop charged with air, and valve means for effectively interchanging the connections to the heat exchangers thereby permitting the indoor heat exchanger to be employed for warming in winter and for cooling in summer, the outdoor heat exchanger including a solar panel having an air conduit and having heat absorbing surfaces thermally coupled to the conduit for warming the conduit by solar radiation, a cold storage device, the valve means including means for interposing the cold storage device in the loop in series with the outlet port of the expander in winter and in series with the inlet port of the expander in summer.

8. The combination as claimed in claim 7 in which the cold storage device is in the form of a tank of water having an air conduit thermally coupled thereto and forming a part of the loop for freezing of the water in the winter and melting of the resulting ice in the summer.

9. In an air conditioning system for an enclosed space, the combination comprising a compressor having an inlet port and an outlet port, an expander having an inlet port and an outlet port, the compressor and expander having rotor means coupled together and including vanes for positive displacement compression and expansion as the rotor means is driven, an indoor heat exchanger in the enclosed space, an outdoor heat exchanger in the ambient atmosphere, one of the heat exchangers being connected in primary position between the compressor outlet port and the expander inlet port and the other heat exchanger being connected in secondary position between the expander outlet port and the compressor inlet port to complete a loop charged with air, valve means for effectively interchanging the connections to the heat exchangers thereby permitting the indoor heat exchanger to be employed for warming in winter and for cooling in summer, the outdoor heat exchanger including a solar panel having an air conduit and having heat absorbing surfaces thermally coupled to the conduit for warming the conduit by solar radiation, a heat storage device, the valve means including means for interposing the heat storage device in series with the outlet port of the compressor during winter daytime hours and in series with the inlet port of the compressor during the winter night.

10. The combination as claimed in claim 7 in which the loop is closed and sealed for recirculation of air and in which the loop contains sufficient air so that the heat exchanger in secondary position operates at a pressure which is substantially above atmospheric.

11. The combination as claimed in claim 9 in which the loop is closed and sealed for recirculation of air and in which the loop contains sufficient air so that the heat exchanger in secondary position operates at a pressure which is substantially above atmospheric.

12. In an air conditioning system for an enclosed space, the combination comprising a compressor having an inlet port and an outlet port, an expander having an inlet port and an outlet port, the compressor and expander having rotor means coupled together and including vanes for positive displacement compression and expansion as the rotor means is driven, an indoor heat exchanger in the enclosed space, and outdoor heat exchanger in the ambient atmosphere, one of the heat exchangers being connected in primary position between the compressor outlet port and the expander inlet port and the other heat exchanger being connected in secondary position between the expander outlet port and the compressor inlet port to complete a closed loop having a charge of air, valve means for effectively interchanging the connections to the heat exchangers thereby permitting the indoor heat exchanger to be employed for warming in winter and for cooling in summer, a cold storage device, the valve means including means for interposing the cold storage device in series with the output port of the expander in winter and in series with the input port of the expander in summer, a heat storage device, and auxiliary valve means for interposing the heat storage device in series with the outlet port of the compressor during winter daytime hours and in series with the inlet of the compressor during the winter night.

13. The combination as claimed in claim 9 including a domestic water heater having a tank of water and a heating air conduit thermally coupled to the water, the heating air conduit having means for interposing the same in the loop adjacent the compressor outlet port thereby to assure a supply of hot water during both winter and summer.

14. In an air conditioning system for an enclosed space, the combination comprising a compressor having an inlet port and an outlet port, an expander having an inlet port and an outlet port, the compressor and expander having rotor means coupled together and including vanes for positive displacement compression and expansion as the rotor means is driven, an indoor heat exchanger in the enclosed space, an outdoor heat exchanger in the ambient atmosphere, the indoor heat exchanger being connected for heat dissipation between the compressor outlet port and the expander inlet port and the outdoor heat exchanger being connected for heat absorption between the expander outlet port and the compressor inlet port to complete a loop charged with air, the outdoor heat exchanger being formed of a solar panel having an air conduit and having heat absorbing surfaces thermally coupled to the conduit for warming the conduit by solar radiation, a heat storage device having an air conduit, and valve means for interposing the heat storage device in series with the outlet port of the compressor during winter daytime hours and in series with the inlet port of the compressor during the winter night.

15. The combination as claimed in claim 14 in which means are provided for disabling the solar panel during the winter night.

* * * * *